US011326842B2

(12) United States Patent
Kim et al.

(10) Patent No.: US 11,326,842 B2
(45) Date of Patent: May 10, 2022

(54) HEAT EXCHANGER AND AIR CONDITIONER HAVING THE SAME

(71) Applicant: Samsung Electronics Co., Ltd, Suwon-si (KR)

(72) Inventors: Hyun Young Kim, Kanagawa (JP); Sato Seiji, Kanagawa (JP); Sang Mu Lee, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 174 days.

(21) Appl. No.: 16/577,994

(22) Filed: Sep. 20, 2019

(65) Prior Publication Data

US 2020/0096206 A1 Mar. 26, 2020

(30) Foreign Application Priority Data

Sep. 21, 2018 (JP) ..... JP2018-177776
Aug. 27, 2019 (KR) ..... 10-2019-0105121

(51) Int. Cl.

| | |
|---|---|
| ***F28F 1/32*** | (2006.01) |
| ***F24F 1/0067*** | (2019.01) |
| ***F24F 1/18*** | (2011.01) |
| ***F28F 1/34*** | (2006.01) |
| ***F28F 1/14*** | (2006.01) |
| ***F28F 1/24*** | (2006.01) |
| ***F28F 1/12*** | (2006.01) |
| *F28D 1/02* | (2006.01) |

(52) U.S. Cl.

CPC ..... *F28F 1/325* (2013.01); *F24F 1/0067* (2019.02); *F24F 1/18* (2013.01); *F28F 1/128* (2013.01); *F28F 1/14* (2013.01); *F28F 1/24* (2013.01); *F28F 1/34* (2013.01); *F28D 1/024* (2013.01)

(58) Field of Classification Search

CPC ... F28D 1/024; F28F 1/128; F28F 1/14; F28F 1/24; F28F 1/34; F28F 1/325

See application file for complete search history.

(56) References Cited

U.S. PATENT DOCUMENTS

| | | | | | |
|---|---|---|---|---|---|
| 4,300,629 | A | * | 11/1981 | Hatada | F28F 1/325 165/151 |
| 4,365,667 | A | * | 12/1982 | Hatada | F28F 1/325 165/151 |
| 4,691,768 | A | * | 9/1987 | Obosu | F28F 1/325 165/151 |
| 5,775,413 | A | * | 7/1998 | Kawanabe | F28F 1/32 165/151 |

(Continued)

*Primary Examiner* — Devon Russell

(57) ABSTRACT

Disclosed are a heat exchanger and an air conditioner including heat transfer tubes configured to guide a refrigerant, and a plurality of fins installed through which the heat transfer tubes penetrate and arranged to be spaced apart from each other in a second direction perpendicular to a first direction such that air passes through the fins in the first direction, wherein the plurality of fins each includes a plurality of inclined portions connected to each other in a zigzag form and inclined with respect to the first direction, and a plurality of louvers formed by being bent to form an angle with the inclined portions after portions of the plurality of inclined portions are cut, wherein a width of each of the plurality of louvers in the first direction after being bent is equal to or less than a width of the louvers in the first direction before being bent.

14 Claims, 10 Drawing Sheets

(56) References Cited

U.S. PATENT DOCUMENTS

| | | | | |
|---|---|---|---|---|
| 6,543,527 | B1 * | 4/2003 | Bouzida | F28F 1/128 165/152 |
| 2008/0190588 | A1 * | 8/2008 | Heidenreich | F28D 1/047 165/151 |
| 2008/0190589 | A1 * | 8/2008 | Kramer | F28F 1/325 165/152 |
| 2010/0006276 | A1 * | 1/2010 | Cremaschi | F28F 1/022 165/175 |
| 2011/0120681 | A1 * | 5/2011 | Seo | F28D 1/0477 165/151 |
| 2013/0199760 | A1 * | 8/2013 | Kadle | F28F 1/128 165/152 |

* cited by examiner

HEAT EXCHANGER AND AIR CONDITIONER HAVING THE SAME

CROSS-REFERENCE TO RELATED APPLICATIONS

This application is based on and claims priority under 35 U.S.C. § 119 to Japanese Patent Application No. JP2018-177776 filed on Sep. 21, 2018 in the Japanese Intellectual Property Office, and Korean Patent Application No. 10-2019-0105121 filed on Aug. 27, 2019 in the Korean Intellectual Property Office, the disclosures of which are herein incorporated by reference in their entirety.

BACKGROUND

1. Field

The disclosure relates to a heat exchanger and an air conditioner having the same to exchange heat between a refrigerant and air.

2. Description of Related Art

In general, an air conditioner includes an indoor heat exchanger that exchanges heat with indoor air and an outdoor heat exchanger that exchanges heat with outdoor air.

The indoor heat exchanger and the outdoor heat exchanger include heat transfer pipes through which a refrigerant passes and fins which the heat transfer pipes pass through to increase the heat exchange area with air.

An example of the fin used in the heat exchanger, includes a corrugated louver fin that is bent in a wave form and includes louvers such that the temperature boundary layer of air passing through the heat exchanger is easily destroyed by the corrugated louver fin, to thereby increasing the heat exchange efficiency.

SUMMARY

It is an aspect of the disclosure to provide a heat exchanger and an air conditioner capable of preventing louvers from being caught in a press mold and stuck to the press mold in the process of manufacturing a corrugated louver fin.

Additional aspects of the disclosure will be set forth in part in the description which follows and, in part, will be obvious from the description, or may be learned by practice of the disclosure.

In accordance with an aspect of the disclosure, a heat exchanger including heat transfer pipes configured to guide a refrigerant, and a plurality of fins installed through which the heat transfer pipes penetrate and arranged to be spaced apart from each other in a second direction perpendicular to a first direction such that air passes through the fins in the first direction, wherein the plurality of fins each includes a plurality of inclined portions connected to each other in a zigzag form and inclined with respect to the first direction, and louvers formed by being bent to form an angle with the inclined portions after portions of the plurality of inclined portions are cut, and a width of the louvers in the first direction after being bent is equal to or less than a width of the louvers in the first direction before being bent.

The louver may extend in the first direction and formed to be bent one or more times.

The louver may include a central portion connected to the inclined portion, a first end portion extending from one side of the central portion toward an upstream side in the first direction, and a second end portion extending from the other side of the central portion toward a downstream side in the first direction.

The first end portion and the second end portion may extend slantly to be close to the first direction.

The first end portion and the second end portion may be parallel to the first direction.

The first end portion and the second end portion may be bent to be gradually close to the first direction.

An end of the first end portion and an end of the second end portion may direct to a direction parallel to the first direction.

The fin may include four of the inclined portions connected to each other in a zigzag form, and the louvers may be formed on four of the inclined portions, respectively.

The fin may include four of the inclined portions connected to each other in a zigzag form, and the louvers may be formed on any one of two of the inclined portions positioned outward and two of the inclined portions positioned inward, among four of the inclined portions.

In accordance with another aspect of the disclosure, an air conditioner including an indoor heat exchanger configured to heat exchange with indoor air, and an outdoor heat exchanger configured to heat exchange with outdoor air, wherein the indoor heat exchanger and the outdoor heat exchanger each include heat transfer pipes configured to guide a refrigerant, and a plurality of fins installed through which the heat transfer pipes penetrate and arranged to be spaced apart from each other in a second direction perpendicular to a first direction such that air passes through the fins in the first direction, the plurality of fins each includes a plurality of inclined portions connected to each other in a zigzag form and inclined with respect to the first direction, and louvers formed by being bent to form an angle with the inclined portions after portions of the plurality of inclined portions are cut, and a width of the louvers in the first direction after being bent is equal to or less than a width of the louvers in the first direction before being bent.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code"

includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
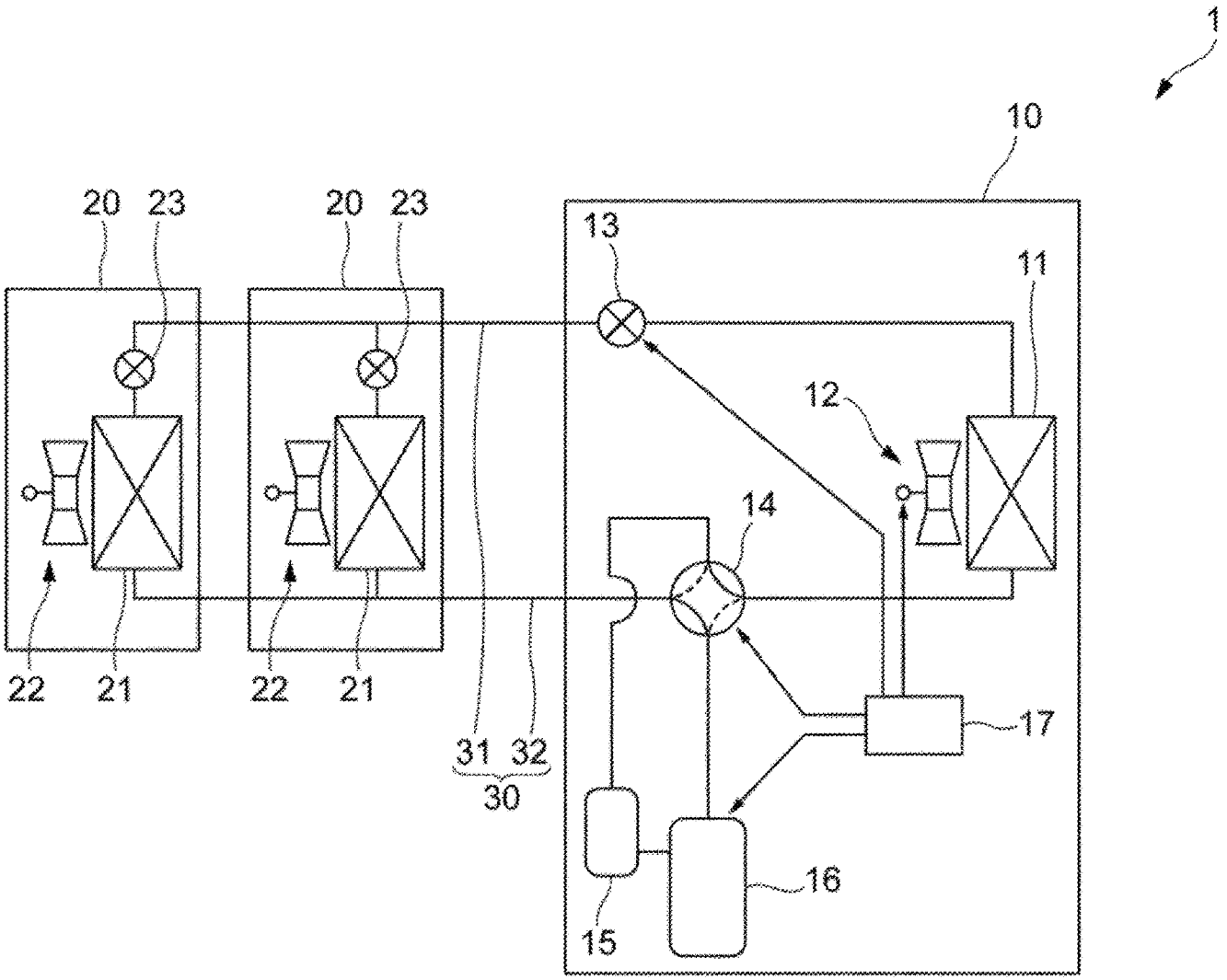
FIG. 1 illustrates a schematic diagram of an air conditioner according to the disclosure.

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments described herein and the configurations shown in the drawings are only examples of embodiments of the disclosure, and various modifications may be made at the time of filing of the disclosure to replace the embodiments and drawings of the specification.

Like reference numbers or signs in the various figures of the application represent parts or components that perform substantially the same functions.

The terms used herein are for the purpose of describing the embodiments and are not intended to restrict and/or to limit the disclosure. For example, the singular expressions herein may include plural expressions, unless the context clearly dictates otherwise. The terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

In this specification, the terms "front," "rear," "upper," "lower," "left," and "right" are defined with reference to the drawings, and the shape and position of each component are not limited by these terms.

Hereinafter an air conditioner according to the disclosure will be described in detail reference to the accompanying drawings.

FIG. 1 illustrates a schematic diagram of an air conditioner according to the disclosure.

An air conditioner 1 includes an outdoor unit 10 installed in an outdoor space, a plurality of indoor units 20 installed in an indoor space, and refrigerant pipes 30 connecting between the outdoor unit 10 and the indoor units 20 to allow a refrigerant to circulate through the outdoor unit 10 and the indoor units 20.

Although FIG. 1 illustrates that two of the indoor units 20 are connected to one of the outdoor unit 10, this shows only an example, and three or more of the indoor units 20 may be connected to one of the outdoor unit 10.

The outdoor unit 10 includes an outdoor heat exchanger 11 for allowing the refrigerant to heat exchange with outdoor air, an outdoor blower 12 for allowing outdoor air to pass through the outdoor heat exchanger 11, and an outdoor expansion valve 13 for allowing the refrigerant to be decompressed and expanded. In addition, the outdoor unit 10 includes a four-way valve 14 for allowing the refrigerant to be delivered to either the outdoor heat exchanger 11 or indoor heat exchangers 21, an accumulator 15 for separating and evaporating a liquid refrigerant, and a compressor 16 for compressing the refrigerant. The four-way valve 14 is connected to the outdoor heat exchanger 11, the accumulator 15, and the compressor 16 through the refrigerant pipes 30, respectively. The outdoor heat exchanger 11 and the outdoor expansion valve 13 are also connected through the refrigerant pipe 30, and the accumulator 15 and the compressor 16 are also connected through the refrigerant pipe 30. HQ. 1 illustrates a case where the air conditioner 1 performs a heating operation.

Further, the outdoor unit 10 includes a controller 17 for controlling the outdoor blower 12, the outdoor expansion valve 13, the compressor 16, and the four-way valve 14. The controller 17 may be implemented by a microcomputer.

The indoor unit 20 includes an indoor heat exchanger 21 for allowing the refrigerant to heat exchange with indoor air, an indoor blower 22 for allowing indoor air to pass through the indoor heat exchanger 21, and an indoor expansion valve 23 for allowing the refrigerant to be decompressed and expanded.

The refrigerant pipes 30 include a liquid refrigerant pipe 31 through which the refrigerant in a liquid state passes, and a gaseous refrigerant pipe 32 through which the refrigerant in a gaseous state passes. The liquid refrigerant pipe 31 allows the refrigerant to flow between the indoor expansion valve 23 and the outdoor expansion valve 13. The gaseous refrigerant pipe 32 guides the refrigerant to move between the four-way valve 14 of the outdoor unit 10 and a gas side of the indoor heat exchanger 21 of the indoor unit 20.

As the refrigerant used in the air conditioner, it is appropriate to use any one of HC single refrigerant, mixed refrigerant including HC, R32, R410A, R407C, and carbon dioxide.

Figure 2:
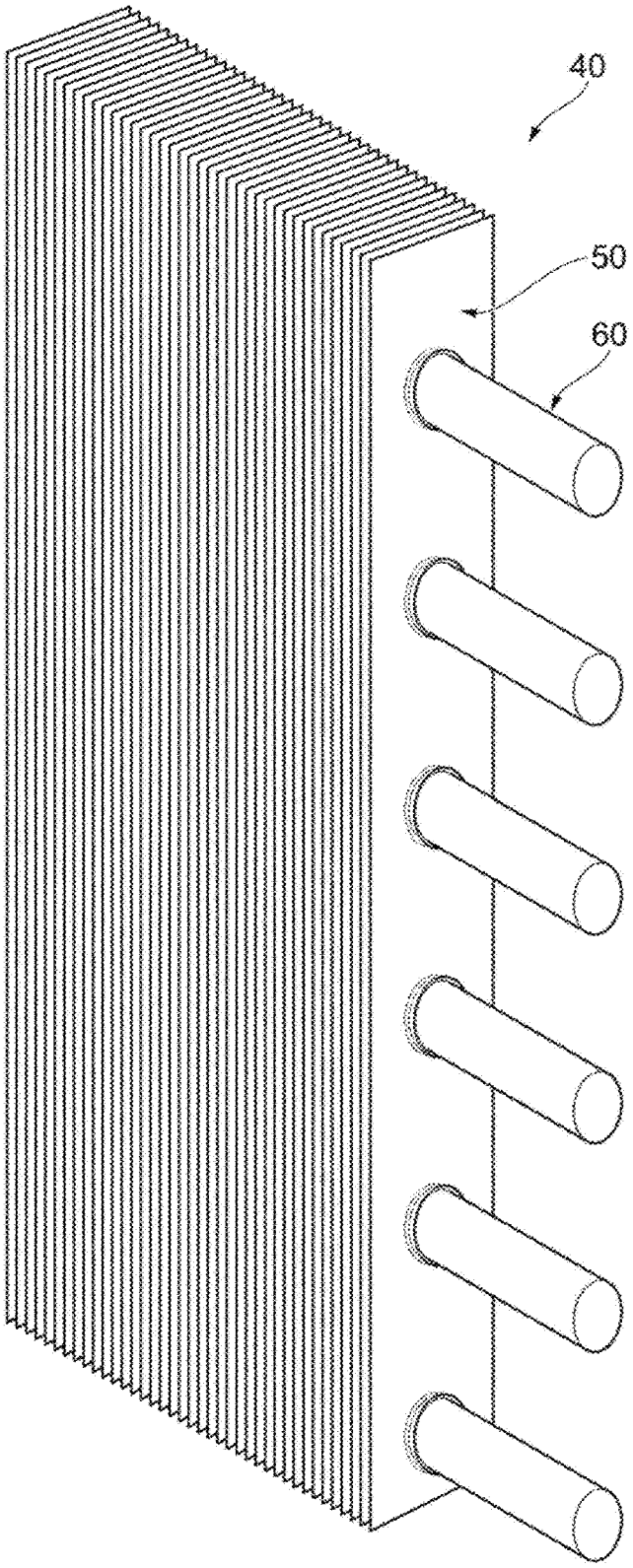
FIG. 2 illustrates a perspective view of a heat exchanger included in the air conditioner according to the disclosure.

FIG. 2 illustrates a perspective view of a heat exchanger 40 according to the disclosure.

The heat exchanger 40 corresponds to at least one of the outdoor heat exchanger 11 or the indoor heat exchanger 21 in FIG. 1.

The heat exchanger 40, which is a fin tube type heat exchanger, includes a plurality of fins 50 made of an aluminum material, and heat transfer tubes 60 of a circular cross section made of copper or aluminum.

The plurality of fins 50 are arranged to be spaced apart from each other by a predetermined distance and to be perpendicular to the heat transfer tubes 60. The plurality of fins 50 are also arranged to be spaced apart from each other in a second direction (left and right directions in FIGS. 3 to 9) perpendicular to a first direction in order to allow air to penetrate the heat exchanger 40 in the first direction (upward direction in FIGS. 3 to 9).

The heat transfer tubes 60 are installed vertically through holes provided in each of the fins 50 and arranged in parallel with each other. The heat transfer tubes 60 are connected to the refrigerant pipes 30 of the air conditioner in FIG. 1 to constitute a refrigeration cycle of a closed circuit.

Because the heat transfer tube 60 is in contact with the fin 50 to transfer or receive heat through the fin 50, the contact area with the air passing through the heat exchanger 40 through the fin 50 is widened. Therefore, heat exchange between the refrigerant passing through the heat transfer tube 60 and air passing through the heat exchanger 40 is efficiently performed through the fin 50.

In order for the heat transfer between the fin 50 and the air to be made more efficiently, the fin 50 may be bent in a zigzag form by traveling through a press mold in the first direction which is the air flow direction to form a corrugated form, or a portion of the surface of the fin 50 may be cut and bent to form louvers.

Also, the fin 50 may be bent in the corrugated form and then the louvers may be formed thereon. As such, when the fin 50 is transformed into the corrugated form or louvers are formed on the fin 50, the temperature boundary layer of the air passing through the heat exchanger 40 may be easily destroyed, thereby facilitating heat transfer between the air and the fins 50 and thus improving the heat exchange efficiency of the heat exchanger 40. Hereinafter the fin 50 in which the louvers are formed after being bent in the corrugated form is referred to as a corrugated louver fin 70.

Figure 3:
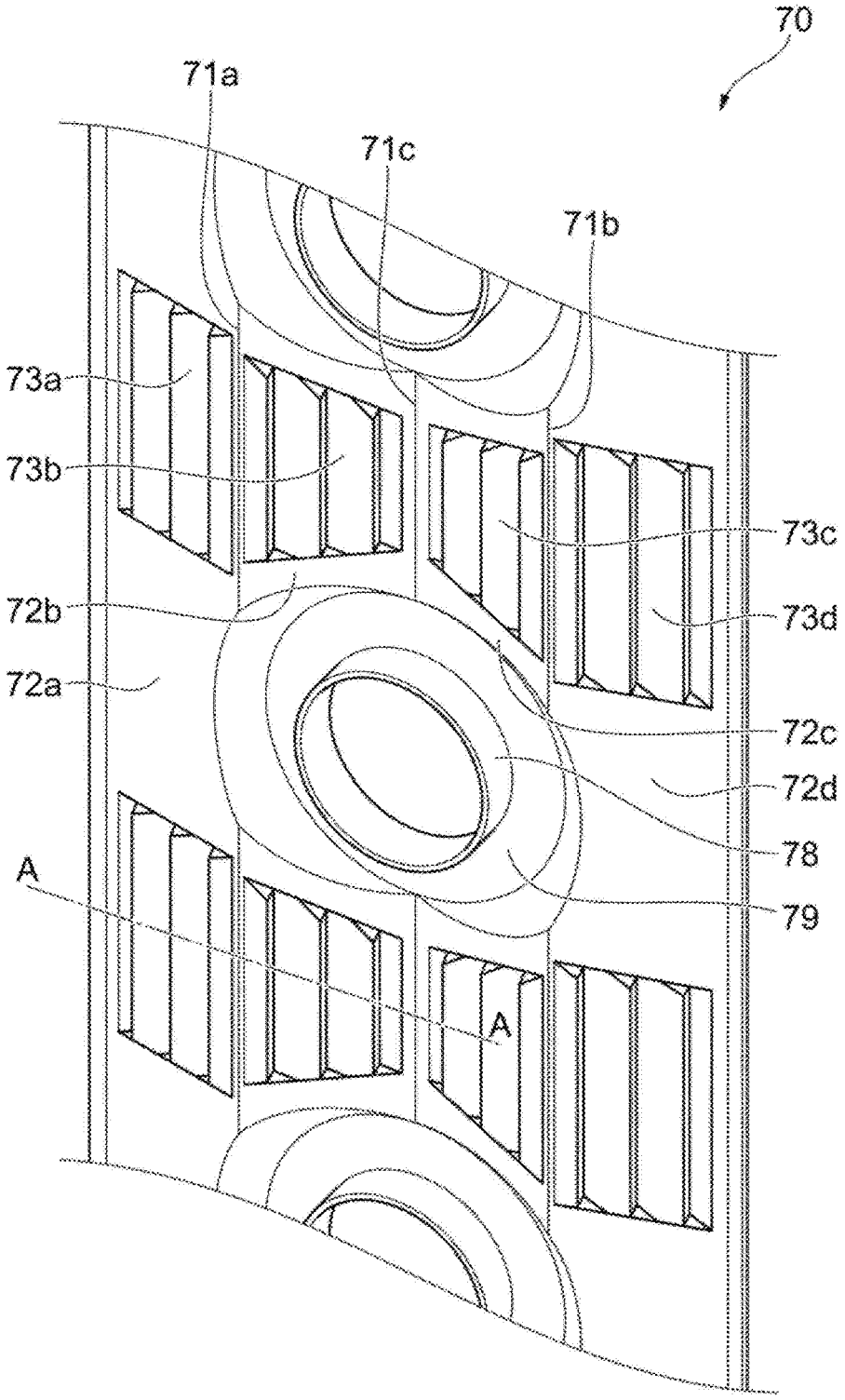
FIG. 3 illustrates a partially enlarged perspective view illustrating an embodiment of a corrugated louver fin included in the air conditioner according to the disclosure.

FIG. 3 illustrates a partially enlarged perspective view of the corrugated louver fin 70.

As illustrated in FIG. 3, the corrugated louver fin 70 includes peak portions 71*a* and 71*b* and a valley portion 71*c*, a left inclined portion 72*a* positioned on the left side of the peak portions 71*a* and 71*b*, inclined portions 72*b* and 72*c* positioned between the peak portions 71*a* and 71*b* and the valley portion 71*c*, and a right inclined portion 72*d* positioned on the right side of the peak portions 71*a* and 71*b*. The peak portions 71*a* and 71*b* and the valley portion 71*c* are folded portions generated when the fin 50 is bent to form the inclined portions 72*a*, 72*b*, 72*c*, and 72*d*, and the inclined portions 72*a*, 72*b*, 72*c*, and 72*d* are inclined portions inclined with respect to a planar portion 51 (FIG. 4) which is the surface of the fin 50 before the inclined portions 72*a*, 72*b*, 72*c*, and 72*d* are formed. Therefore, the corrugated louver fin 70 includes the inclined portions 72*a*, 72*b*, 72*c*, and 72*d* connected to each other in a zigzag form through the peak portions 71*a* and 71*b* and the valley portion 71*c*. The inclined portions 72*a*, 72*b*, 72*c*, and 72*d* are also inclined with respect to the first direction which is the direction in which air passes through the heat exchanger 40.

Louvers 73*a* to 73*d* are formed on the inclined portions 72*a*, 72*b*, 72*c*, and 72*d*, respectively. The corrugated louver fin 70 further includes collars 78 in surface contact with the heat transfer tubes 60 and sheet surfaces 79 necessary to form the collars 78.

As described above, when the fin 50 is bent in the corrugated form and louvers 73*a* to 73*d* are formed on the fin 50 to form the corrugated louver fin 70, heat transfer is promoted, but the following problem may occur.

Figure 4:
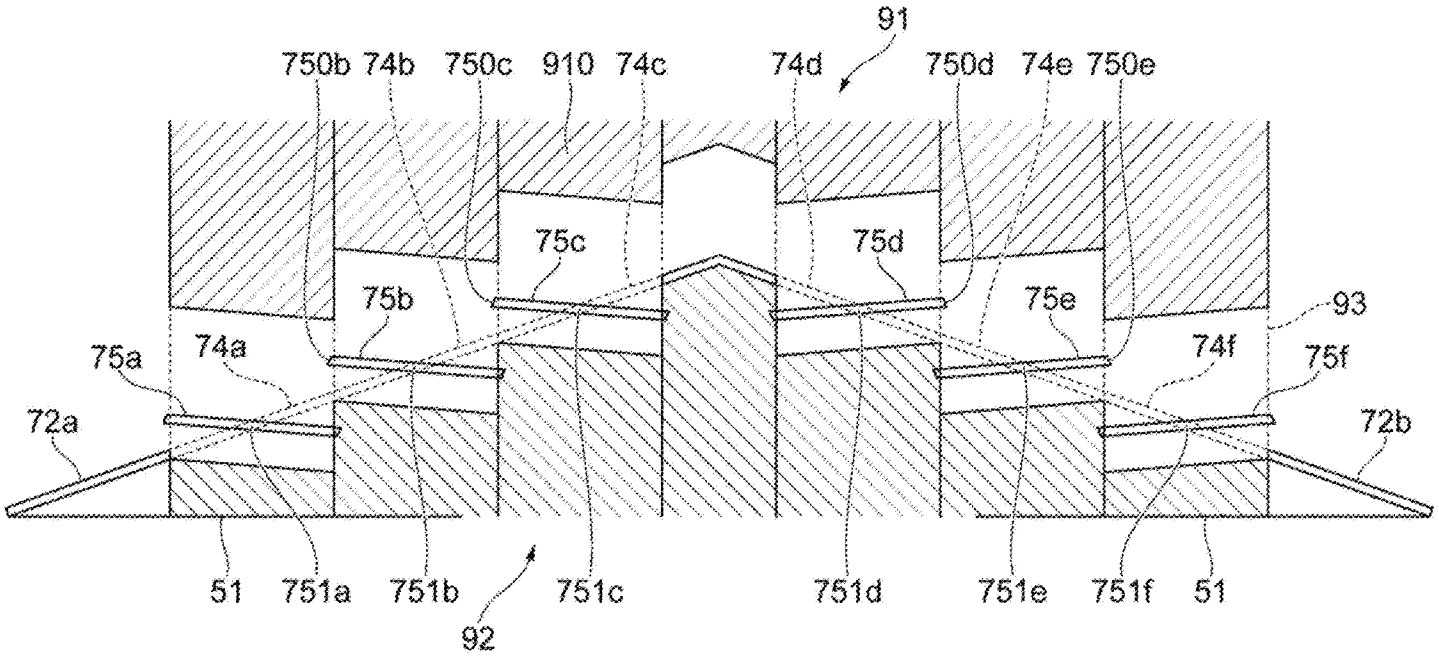
FIG. 4 illustrates a cross-sectional view illustrating that louvers are formed again on a fin bent in a wave form.

FIG. 4 illustrates a cross-sectional view taken along line A-A in FIG. 3 to explain a problem occurring when the corrugated louver fin 70 is formed as described above.

FIG. 4 illustrates processes of forming a plurality of louvers 75*a* to 75*f* on the inclined portions 72*a* and 72*b* formed on the fin 50 and forming the louvers 75*a* to 75*f* on the inclined portions 72*a* and 72*b*. The fin 50 is in a state where the inclined portions 72*a* and 72*b* are formed by being bent through a sequential transfer press process, and as an upper mold 91 and a lower mold 92 of the press mold shown in FIG. 4 moves downward and upward along traveling lines 93, respectively, the louvers 75*a* to 75*f* are formed on the inclined portions 72*a* and 72*b* again. The louvers 75*a* to 75*f* are formed by cutting and bending a portion of the inclined portions 72*a* and 72*b* by the upper mold 91 and the lower mold 92. Connection portions 751*a* to 751*f* connected to the inclined portions 72*a* and 72*b* on the louvers 75*a* to 75*f* are disposed at substantially equal intervals. However, the present invention is not limited thereto, and the intervals between the connection portions 751*a* to 751*f* may not necessarily be the same.

As illustrated in FIG. 4, when the louvers 75*a* to 75*f* are approached in a direction parallel to the planar portion 51 which is the surface of the fin 50 before the inclined portions 72*a* and 72*b* are not formed, the length when the louvers 75*a* to 75*f* formed on the inclined portions 72*a* and 72*b* are projected onto the planar portion 51 may become longer than the length when the initial inclined portions 74*a* to 74*f* before the louvers 75*a* to 75*f* are formed are projected onto the planar portion 51. That is, when the louvers 75*a* to 75*f* formed by cutting are bent to be inclined with respect to the inclined portions 72*a* and 72*b*, a width in the first direction after the louvers 75*a* to 75*f* are bent may become greater than a width in the first direction before the louvers 75*a* to 75*f* are bent.

As described above, when the width of the louvers 75*a* to 75*f* in the first direction becomes larger after being bent than before being bent, interfering portions 750*b* to 750*e* fitted between punches 910 of the upper mold 91 may be inevitably generated at opposite ends of the louvers 75*a* to 75*f*, and thus the louvers 75*a* to 75*f* may not be separated from the upper mold 91.

Figure 5:
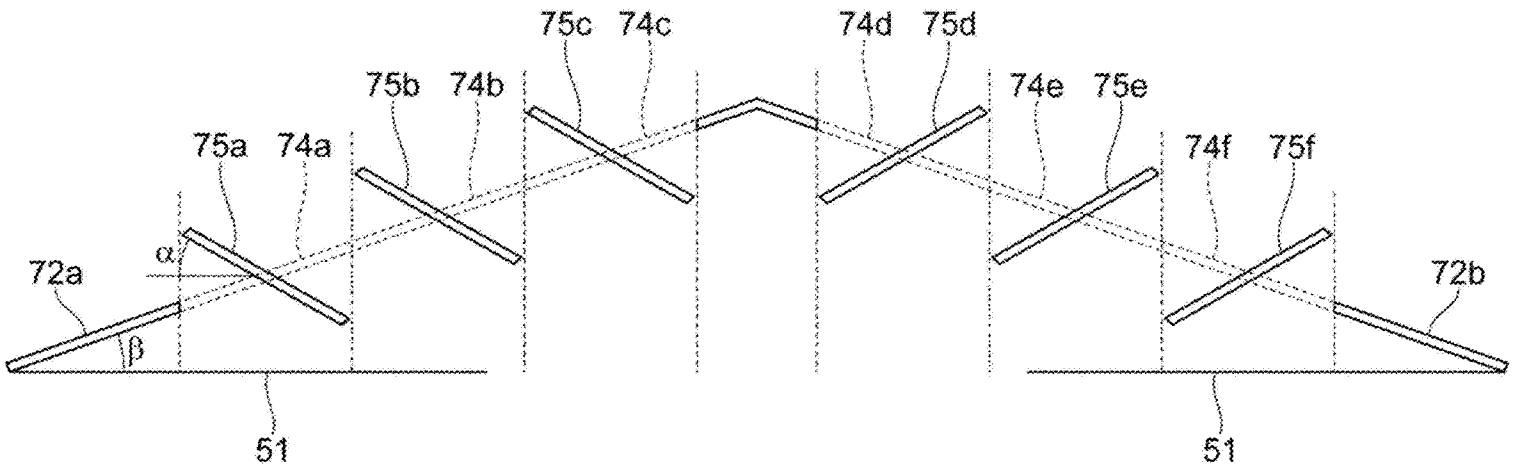
FIG. 5 illustrates a cross-sectional view taken along line A-A in FIG. 3 and illustrates an example of louvers bent such that a width in a first direction after being bent is less than or equal to the width in the first direction before being bent.

FIG. 5 is a view illustrating an example for solving the above problem, and is a cross-sectional view taken along the line A-A in FIG. 3. The louvers 75*a* to 75*f* illustrated in FIG. 5 are formed to be inclined at a larger angle with respect to the planar portion 51. That is, an angle α formed by the louvers 75*a* to 75*f* with the planar portion 51 is larger than an angle β formed by the inclined portions 72*a* and 72*b* with the planar portion 51. The length when the louvers 75*a* to 75*f* formed as described above are projected onto the planar portion 51 is equal to or shorter than the length when the initial inclined portions 74*a* and 74*b* before the louvers 75*a* to 75*f* are formed are projected onto the planar portion 51. That is, the width in the first direction after the louvers 75*a* to 75*f* are bent is equal to the width in the first direction before the louvers 75*a* to 75*f* are bent, or the width in the first direction after the louvers 75*a* to 75*f* are bent becomes shorter than the width in the first direction before the louvers 75*a* to 75*f* are bent.

However, as described above, because the flow direction of air is sharply changed by the louvers 75*a* to 75*f* when the angle between the louvers 75*a* to 75*f* and the planar portion 51 becomes large as described above, the flow path resistance acting on the air passing through the corrugated louver fin 70 is increased by the louvers 75*a* to 75*f*, thereby reducing the amount of air flowing through the heat exchanger 40. Therefore, when the angle formed by the louvers 75*a* to 75*f* with the planar portion 51 is increased by a predetermined value or more, the heat exchange efficiency of the heat exchanger 40 may be reduced.

Accordingly, the louvers 75*a* to 75*f* are bent without increasing the angle formed between the louvers 75*a* to 75*f* and the planar portion 51 so that the length when the louvers 75*a* to 75*f* are projected onto the planar portion 51 is equal to or shorter than the length when the initial inclined portions 74*a* to 74*f* before the louvers 75*a* to 75*f* are formed are projected onto the planar portion 51. That is, the width of the louvers 75*a* to 75*f* in the first direction is made to be the same as before being bent and after being bent, or shorter after being bent than before being bent. The planar portion 51 is a vertical plane approximately perpendicular to the heat transfer tubes 60, and the initial inclined portions 74*a* to 74*f* are regions on which the louvers 75*a* to 75*f* are to be formed.

Hereinafter the corrugated louver fin 70 according to a first embodiment as described above will be described with reference to FIG. 6.

Figure 6:
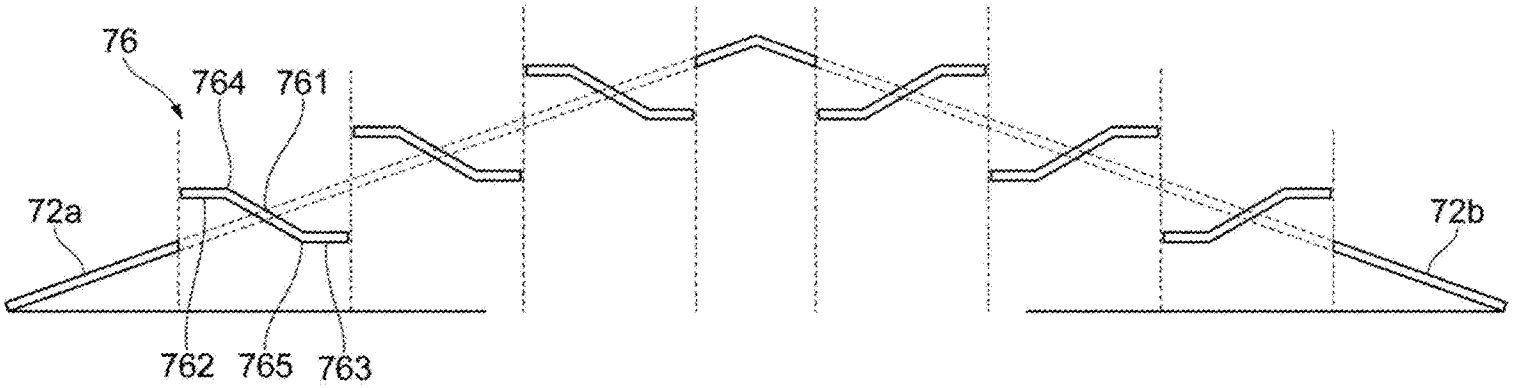
FIG. 6 illustrates a cross-sectional view taken along the line A-A in FIG. 3 and illustrates louvers according to a first embodiment of the disclosure.

FIG. 6 illustrates a cross-sectional view taken along the line A-A in FIG. 3 to illustrate the louvers 75*a*, 75*b*, and 75*c* bent in two steps.

Louvers 76 extend in a width direction and are bent one or more times. The louvers 76 may be bent in one time, or two or more times, that is, in multiple steps.

The louvers 76 each include a central portion 761 connected to one of the inclined portions 72*a* and 72*b* through the above-described connecting portion, a first end portion 762 extending from one end of the central portion 761 toward an upstream side in the first direction, which is the flow direction of air, and a second end portion 763 extending from the other end of the central portion 761 toward a downstream side in the first direction.

The first end portion 762 extends slantly with respect to the central portion 761 so that a first bent portion 764 is formed between the first end portion 762 and the central portion 761, and the second end portion 763 extends slantly with respect to the central portion 761 so that a second bent portion 765 is formed between the second end portion 763 and the central portion 761.

It is appropriate that the first end portion 762 and the second end portion 763 extend slantly to be closer to the first direction than the extending direction of the central portion 761 or extend parallel to the first direction, so that air is guided back in the first direction.

Hereinafter a second embodiment of the disclosure will be described with reference to FIG. 7.

Figure 7:
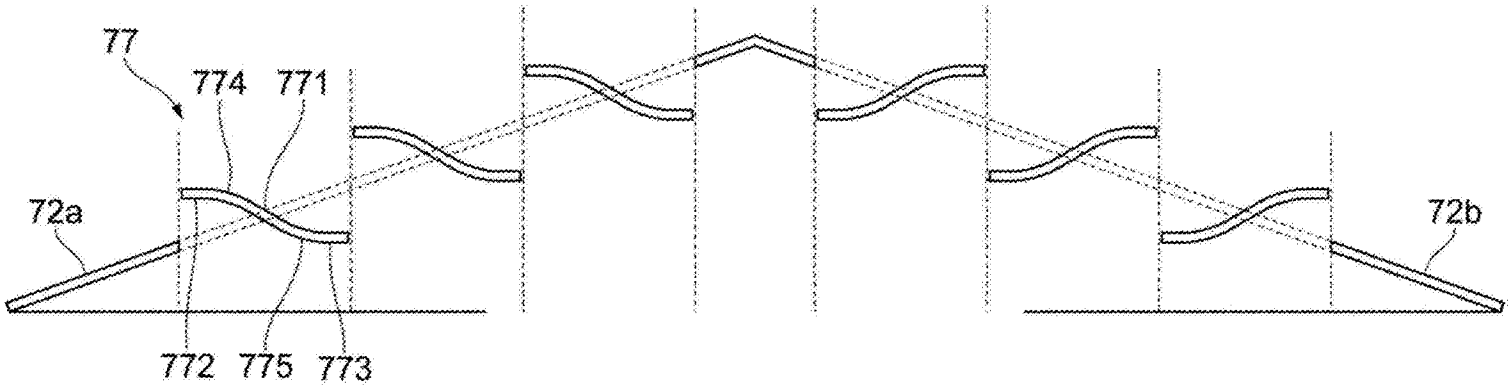
FIG. 7 illustrates a cross-sectional view taken along line the line A-A in FIG. 3 and illustrates louvers according to a second embodiment of the disclosure.

FIG. 7 is a cross-sectional view taken along the line A-A in FIG. 3 and illustrates that a louver 77 is formed to be bent so that air may move smoothly along the surface of the louver 77.

The louvers 77 each include a central portion 771 connected to one of the inclined portions 72*a* and 72*b* through the above-described connection portion, a first end portion 772 extending to be bent from one end of the central portion 771, and a second end portion 773 extending to be bent from the other end of the central portion 771.

The first end portion 772 and the second end portion 773 extend to be bent in a direction closer to the extending direction of the inclined portions 72*a* and 72*b* than the extending direction of the central portion 771. That is, the first end portion 772 and the second end portion 773 extend and are bent to be gradually close to the first direction so that the change in the flow direction of air is gradually made, thereby minimizing the increase in the flow path resistance by the louver 77.

It is appropriate that when the louver 77 is bent, an end of the first end portion 772 and an end of the second end portion 773 direct to a direction parallel to the first direction so that the louver 77 guides air back in the first direction.

Hereinafter the effect of the louver 76 according to the first embodiment will be described with reference to FIGS. 8 and 9.

Figure 8:
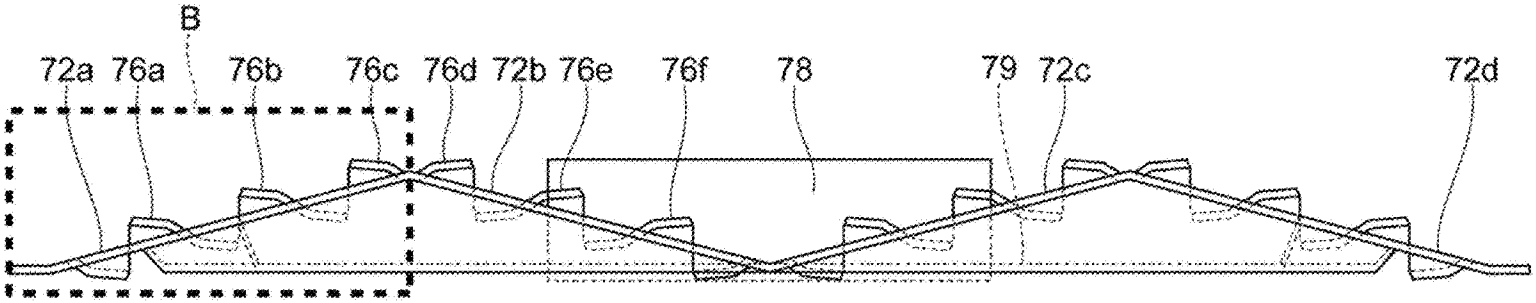
FIG. 8 illustrates a bottom view of the corrugated louver fin illustrated in FIG. 3.
Figure 9:
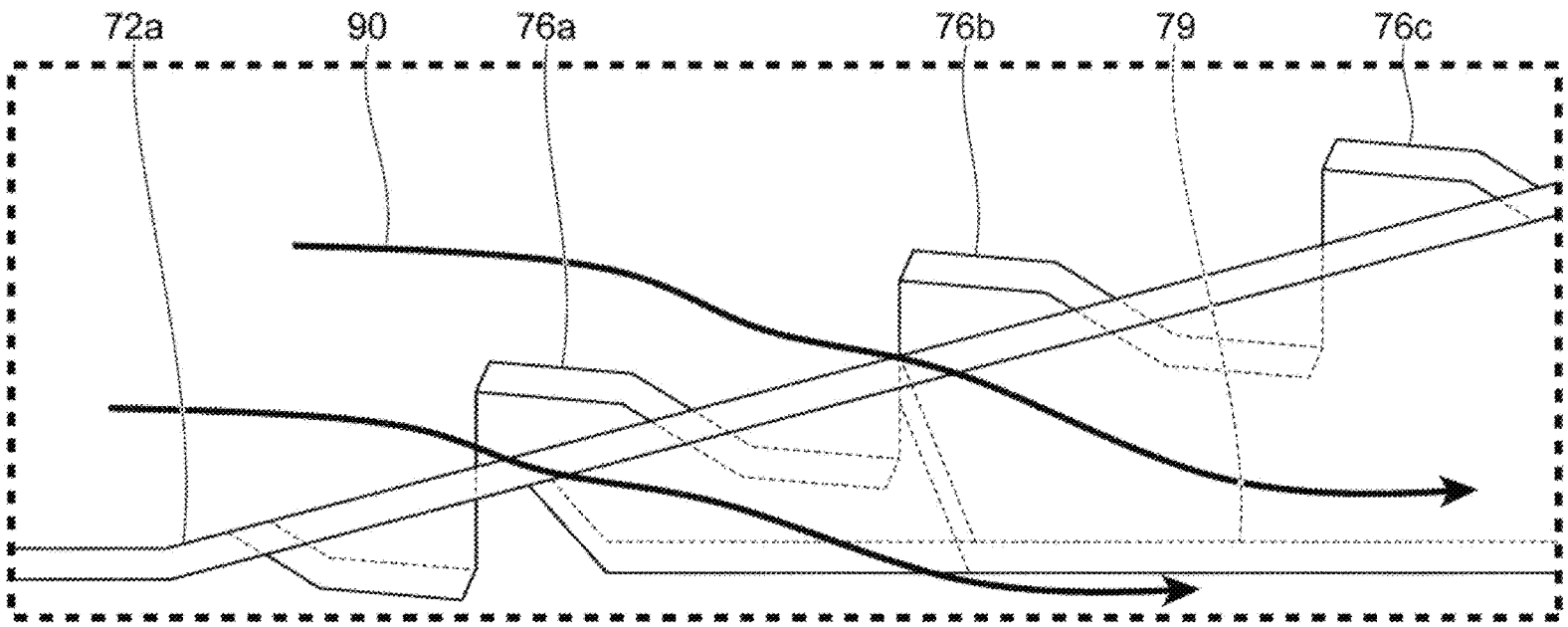
FIG. 9 illustrates an enlarged view of a portion B of FIG. 8.

FIG. 8 is a bottom view of the corrugated louver fin 70 in FIG. 3 and illustrates the inclined portions 72*a* and 72*b*, the louver 76, the collar 78, and the sheet surface 79, FIG. 9 is an enlarged view of a portion B in FIG. 8, and illustrates the inclined portions 72*a* and 72*b*, the louver 76, and the sheet surface 79, and further illustrates a flow 90 of air passing through the corrugated louver fin 70. As illustrated in the figure, air moves along the surface of the louver 76. At this time, the direction of the air flow 90 is smoothly changed twice because the louver 76 extends in the first direction and is in a state of being bent in two steps. Therefore, the increase in the flow path resistance by the louver 76 may be maintained below a certain level.

In addition, when the louvers 77 are formed to be bent as in the second embodiment, the increase in the flow path resistance by the louvers 77 may be maintained below a certain level because the change in the flow direction of air is gradually made.

As the louver 76 is bent in one time, or two or more times, that is, in multiple steps as in the above-described embodiment, or the louver 77 is formed to be bent, while the flow path resistance acting on the air passing through the louvers 76 and 77 is reduced, interference between the louvers 76 and 77 and the press mold is prevented, so that the corrugated louver fin 70 produced through the press mold may be prevented from being caught in the press mold.

Figure 10:
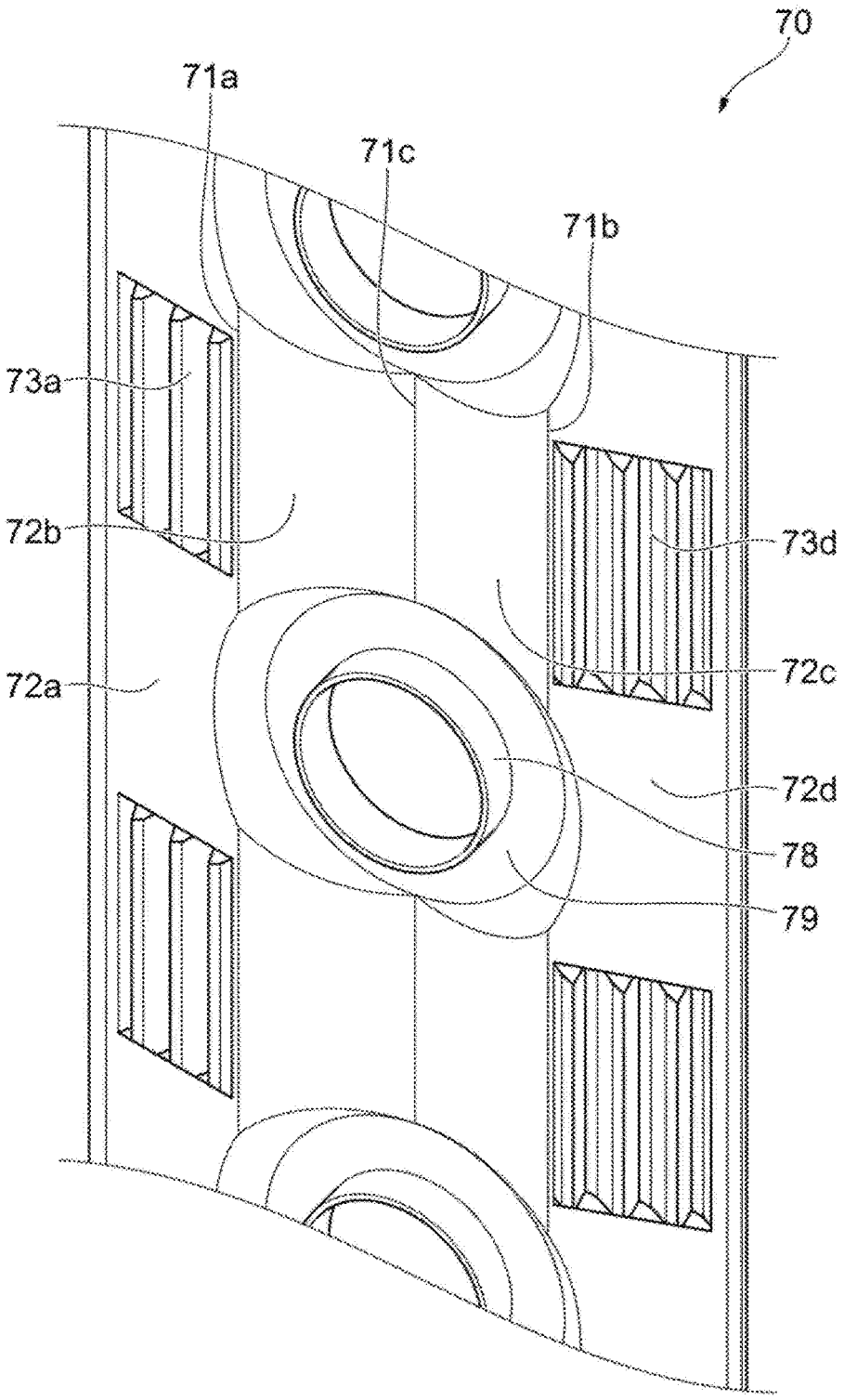
FIG. 10 illustrates a partially enlarged perspective view of a corrugated louver fin illustrating another embodiment of the corrugated louver fin included in the air conditioner according to the disclosure.

FIG. 3 illustrates that the louvers 73*a* to 73*d* are formed on all the inclined portions 72*a*, 72*b*, 72*c*, and 72*d*, but the disclosure is not limited thereto. As illustrated in FIG. 10, the louvers 73*a* and 73*d* may be formed on the inclined portions 72*a* and 72*d* which are some of the inclined portions 72*a*, 72*b*, 72*c* and 72*d*.

FIG. 10 illustrates the corrugated louver fin 70 in which the louvers 73*a* and 73*d* are formed on the inclined portions 72*a* and 72*d* positioned outward among the inclined portions 72*a*, 72*b*, 72*c* and 72*d*. The corrugated louver fin 70 also includes the peak portions 71*a* and 71*b* and the valley portion 71*c*, the left inclined portion 72*a* positioned on the left side of the peak portions 71*a* and 71*b*, the inclined portions 72*b* and 72*c* positioned between the peak portions 71*a* and 71*b* and the valley portion 71*c*, and the right inclined portion 72*d* positioned on the right side of the peak portions 71*a* and 71*b*. The corrugated louver fin 70 further includes the collars 78 in surface contact with the heat transfer tubes 60 and the sheet surfaces 79 necessary to form the collars 78.

Although FIG. 10 illustrates that the louvers 73*a* and 73*d* are formed on the inclined portions 72*a* and 72*d* positioned outward among the inclined portions 72*a*, 72*b*, 72*c* and 72*d*, the disclosure is not limited thereto, and the louvers 73*a* and 73*d* may be formed on the inclined portions 72*b* and 72*c* positioned inward among the inclined portions 72*a*, 72*b*, 72*c* and 72*d*.

In addition, the corrugated louver fin 70 includes four of the inclined portions 72*a*, 72*b*, 72*c* and 72*d*, but the disclosure is not limited thereto, and the corrugated louver fin 70 may include two, three, or five or more of the inclined portions.

As is apparent from the above, in louvers of a tin included in a heat exchanger and an air conditioner according to an aspect of the disclosure, the width of the louvers in a first direction, which is the flow direction of air after being bent, becomes equal to or less than the width in the first direction before being bent, so that the fin can be prevented from being caught in a press mold in a process of forming the louvers.

Although the present disclosure has been described with various embodiments, various changes and modifications may be suggested to one skilled in the art. It is intended that the present disclosure encompass such changes and modifications as fall within the scope of the appended claims.

What is claimed is:

1. A heat exchanger comprising:

heat transfer tubes configured to guide a refrigerant; and a plurality of fins installed which the heat transfer tubes pass through, configured to be spaced apart from each other in a second direction perpendicular to a first direction such that air passes through the fins in the first direction, wherein the plurality of fins each includes:

a plurality of inclined portions connected to each other in a zigzag form and inclined with respect to the first direction, and a plurality of louvers formed by portions of the plurality of inclined portions that are cut at a first width in the first direction and bent to form an angle with the inclined portions with a second width in the first direction, wherein the second width is equal or less than the first width, wherein the plurality of louvers extend in the first direction and include one or more bends.

2. The heat exchanger according to claim 1, wherein each of the plurality of louvers includes:

a central portion connected to the inclined portions, a first end portion extending from one side of the central portion toward an upstream side in the first direction, and a second end portion extending from the other side of the central portion toward a downstream side in the first direction.

3. The heat exchanger according to claim 2, wherein the first end portion and the second end portion are parallel to the first direction.

4. The heat exchanger according to claim 2, wherein an end of the first end portion and an end of the second end portion are parallel to the first direction.

5. The heat exchanger according to claim 1, wherein:

the plurality of fins include four of the inclined portions connected to each other in a zigzag form; and the plurality of louvers are formed on the four of the inclined portions, respectively.

6. The heat exchanger according to claim 1, wherein:

the plurality of fins include four of the inclined portions connected to each other in a zigzag form; and the plurality of louvers are formed on one of two of the inclined portions positioned outside among the four of the inclined portions and two of the inclined portions positioned inside among the four of the inclined portions.

7. An air conditioner comprising:

an indoor heat exchanger configured to exchange heat with indoor air; and an outdoor heat exchanger configured to exchange heat with outdoor air, wherein the indoor heat exchanger and the outdoor heat exchanger are each comprising:

heat transfer tubes configured to guide a refrigerant; and a plurality of fins installed which the heat transfer tubes pass through, configured to be spaced apart from each other in a second direction perpendicular to a first direction such that air passes through the fins in the first direction, wherein the plurality of fins each include a plurality of inclined portions connected to each other in a zigzag form and inclined with respect to the first direction, and a plurality of louvers formed by portions of the plurality of inclined portions that are cut at a first width in the first direction and bent to form an angle with the inclined portions with a second width in the first direction, wherein the second width is equal to or less than the first width, and wherein the plurality of louvers extend in the first direction and include one or more bends.

8. The air conditioner according to claim 7, wherein each of the plurality of louvers includes:

a central portion connected to the inclined portions, a first end portion extending from one side of the central portion toward an upstream side in the first direction, and a second end portion extending from the other side of the central portion toward a downstream side in the first direction.

9. The air conditioner according to claim 8, wherein the first end portion and the second end portion are parallel to the first direction.

10. The air conditioner according to claim 8, wherein an end of the first end portion and an end of the second end portion are parallel to the first direction.

11. The air conditioner according to claim 7, wherein each of the plurality of louvers include a central portion connected to the inclined portions, a first end portion extending and curved from one side of the central portion toward an upstream side in the first direction, and a second end portion extending and curved from the other side of the central portion toward a downstream side in the first direction.

12. The air conditioner according to claim 11, wherein an end of the first end portion and an end of the second end portion are directed in a parallel direction to the first direction.

13. The air conditioner according to claim 7, wherein:

the plurality of fins include four of the inclined portions connected to each other in a zigzag form; and the plurality of louvers are formed on the four of the inclined portions, respectively.

14. The air conditioner according to claim 7, wherein:

the plurality of fins include four of the inclined portions connected to each other in a zigzag form; and the plurality of louvers are formed on one of two of the inclined portions positioned outside among the four of the inclined portions and two of the inclined portions positioned inside among the four of the inclined portions.

* * * * *